US005758428A

United States Patent [19]

Kotlinski

[11] Patent Number: 5,758,428

[45] Date of Patent: Jun. 2, 1998

[54] RAFTER MEASURING AND POSITIONING TEMPLATE AND METHOD

[76] Inventor: M. George Kotlinski, 326 Hawthorne Rd., Pittsburgh, Pa. 15209

[21] Appl. No.: 712,463

[22] Filed: Sep. 11, 1996

[51] Int. Cl.[6] ..... B43L 7/10

[52] U.S. Cl. ..... 33/416; 33/461; 33/462; 33/562

[58] Field of Search ..... 33/415, 416, 417, 33/423, 461, 462, 809, 562

[56] References Cited

U.S. PATENT DOCUMENTS

| | | | |
|---|---|---|---|
| 407,288 | 7/1889 | Fletcher | 33/415 |
| 994,741 | 6/1911 | Gorenflo | 33/462 |
| 1,489,789 | 4/1924 | Ryan | 33/461 |
| 1,809,401 | 6/1931 | Cattell | 33/462 |
| 1,825,759 | 10/1931 | Smith | 33/462 |
| 2,212,331 | 8/1940 | Tracy | 33/417 |
| 2,744,332 | 5/1956 | Day | 33/416 |
| 2,908,080 | 10/1959 | Varbel | 33/423 |
| 4,328,619 | 5/1982 | Lefevre et al. | 33/415 |
| 4,462,166 | 7/1984 | Furlong | 33/416 |
| 4,553,333 | 11/1985 | Shurtliff | 33/416 |

*Primary Examiner*—Thomas B. Will

*Attorney, Agent, or Firm*—Armstrong, Westerman, Hattori, McLeland & Naughton

[57] ABSTRACT

A rafter measuring and positioning template and method provides a device and method wherein a telescoping pole has rotatably and swivelably mounted on one end thereof a pad having a slide plate for juxtaposition to a ridge board, and, on the other end, a base angle having a slide clamp for juxtaposition to a wall plate, to measure the angle between the ridge board and the pad and thereby the angle of cut of the top of the rafter to be cut, and the length of the rafter between the ridge board and the wall plate.

19 Claims, 7 Drawing Sheets

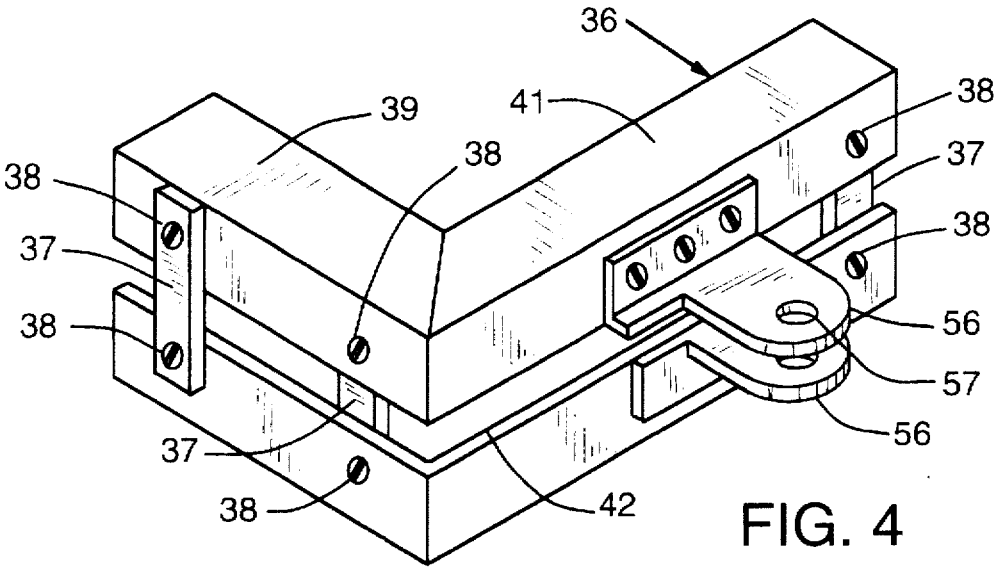
FIG. 4
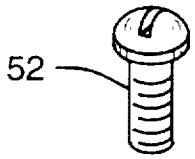
FIG. 6A
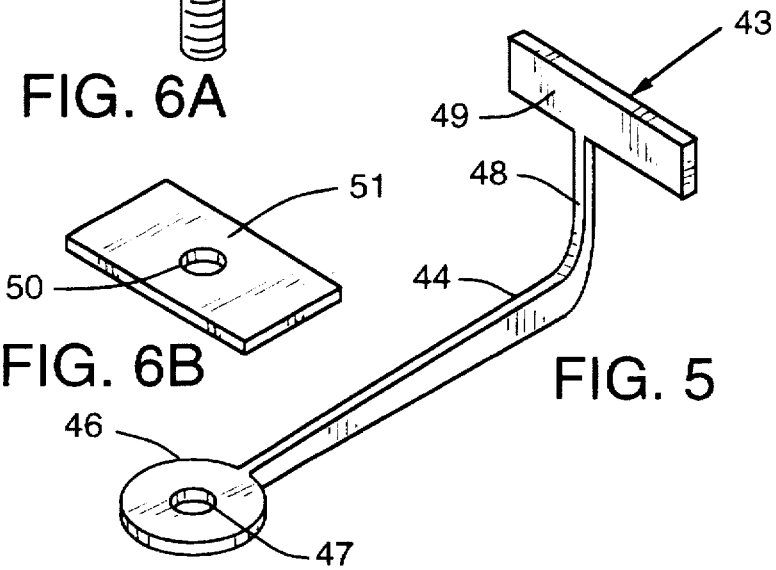
FIG. 6B
FIG. 5
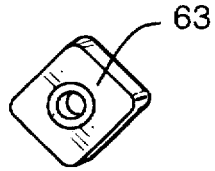
FIG. 7C
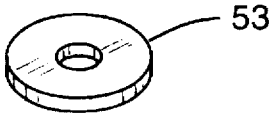
FIG. 6C
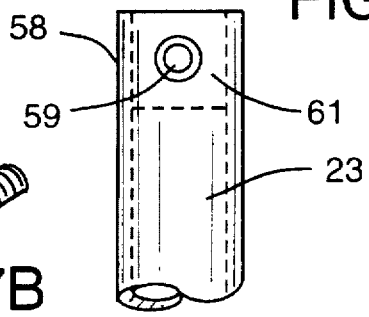
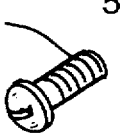
FIG. 7B
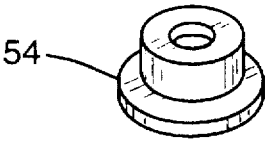
FIG. 6D
FIG. 7A

RAFTER MEASURING AND POSITIONING TEMPLATE AND METHOD

BACKGROUND

1. Field of the Invention

This invention relates to a device and method for measuring and positioning building roof rafters and, more particularly, to such device and method capable of determining a straight or a compound angle between a building ridge board or ledger board and a first measuring head on one end of a telescoping pole having at the other end a second measuring head to engage a building wall plate, and adapted to measure the distance between the ledger board and the wall plate.

2. Prior Art

Prior to the present invention the determination of angles at the ridge board (the board at the top or ridge of a gabled or hipped roof building) or a ledger board (a generally horizontally extending board other than the ridge board) and the measurement of the distance from the ridge board or the ledger board and the wall plate (an elongated element placed on the top of the wall studs) were done essentially by trial and error, using a carpenter's square with special markings to get the relevant angles and then flipping the square over and over to determine the distance. Such procedure is complicated, difficult and innacurate. For present purposes, the use of the term "ridge board" is to be understood as including also a ledger board.

SUMMARY OF THE INVENTION

The present invention provides a device comprising a common form of telescoping pole having loosening and tightening rings and extendible to a length inclusive of the usual maximum length of a building rafter. A pad, formed of wood, plastic, composites, metal, or other suitable material, comprises an elongated, generally rectangular body hingedly connected to a first, apertured, end of the pole by means of a pair of upstanding and apertured ears borne by a swivel element of the pad and which ears are attached to the pole by a threaded nut or knob and bolt arrangement in which the bolt extends through the apertures of the ears of the swivel element and the apertures of the first end of the pole, thereby forming a joint about which the pad can swivel to conform to the position of a ridge board when the pad is juxtaposed thereto.

The other end of the pole carries a base angle comprising a pair of arms which may be of generally U-shaped cross-section and which arms are at right angles to each other and one of which is slotted to slidingly receive a slide clamp. One end of the slide clamp is apertured to receive a threaded nut or knob and bolt arrangement to loosen and tighten the clamp at fixed positions along the length of the slot in the one arm of the base angle. The other end of the slide clamp preferably is of a T-shape, the cross element of the T being adapted to engage the wall plate being measured. The slotted arm of the base plate has two upstanding, apertured, ears which, by means of a threaded nut or knob and bolt arrangement, are attached to the apertured other end of the pole and which serves to loosen and tighten the base angle so that it may be positioned against the wall plate.

The length of a rafter to be cut, and the angle at which the top of the rafter is to be cut, are determined by positioning the device between the ridge board and the wall plate, with the pad against the ridge board, and loosening the rings of the telescoping pole so that the base angle rests on the wall plate, then tightening the rings of the telescoping pole to fix the distance thus determined. The angle between the pad and the ridge board is the angle at which the top end of the rafter is to be cut.

BRIEF DESCRIPTION OF THE DRAWINGS

FIG. 4 is a perspective view of the base angle;

FIG. 5 is a perspective view, in exaggerated size, of the slide clamp;

FIGS. 6A–6D are perspective views of the bolt, plate, washer, and tightening know arrangement to slidingly mount the slide clampb within the slot of the slotted arm of the base angle;

FIG. 7A is a side view of the other end of the pole, to which the base angle is attached;

FIGS. 7B and 7C are perspective views of the nut and bolt arrangement to attach the pole to the base angle;

DESCRIPTION OF PREFERRED EMBODIMENTS

Figure 1:
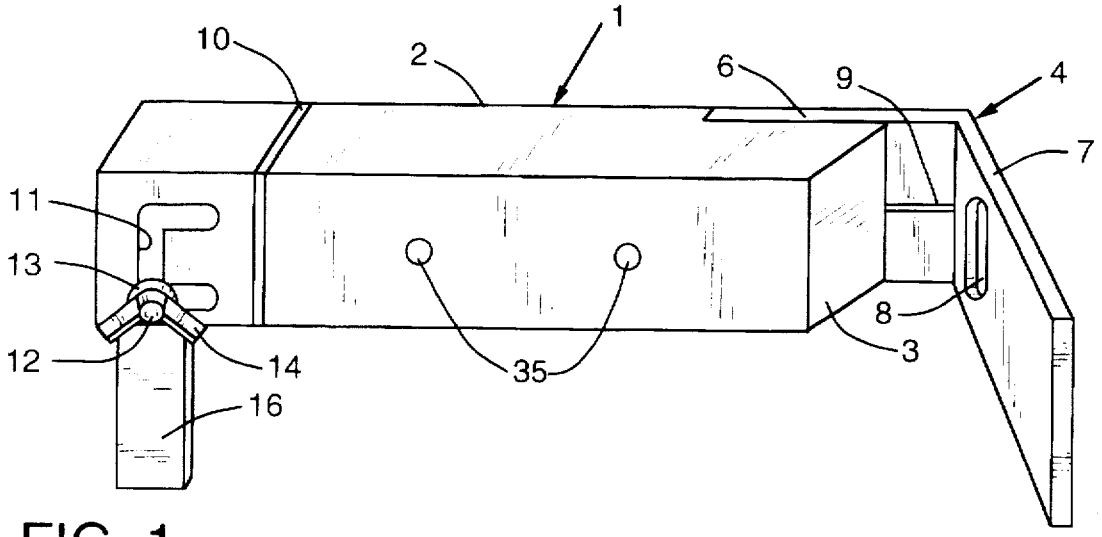
FIG. 1 is a perspective view of the pad, with body and attached base angle and slide plate.

As shown in FIG. 1, a pad, denoted generally by the numeral 1, comprises an elongated, generally rectangular, body 2. One end of body 2 is a bevelled surface, as at 3, to which end there is secured one arm 6 of a base 4, the other arm 7 of the base extending at a right angle to arm 6 and having a slot 8 extending transversely of the arm 7. Arm 6 is provided with a reference mark 9. The other end of the pad 1 is provided with a generally U-shaped slot 11 extending through the width of body 2 and adapted to receive a threaded bolt 12 passing through a washer 13 and held in place by a wingnut 14. A reference line 10 extends about the block 2 near the slotted end of body 2. A slide plate 16 has an aperture near one end thereof through which bolt 12 passes to permit slide plate 16 to slidably move in slot 11.

Figure 2E:
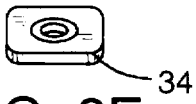
FIGS. 2A, 2B and 2D–2G are perspective views of the nut and bolt arrangements (with washers) for attaching the swivel element to the pole and to the pad.
Figure 2A:
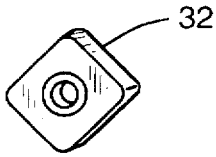
Figure 2F:
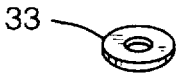
Figure 2B:
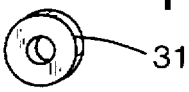
Figure 2C:
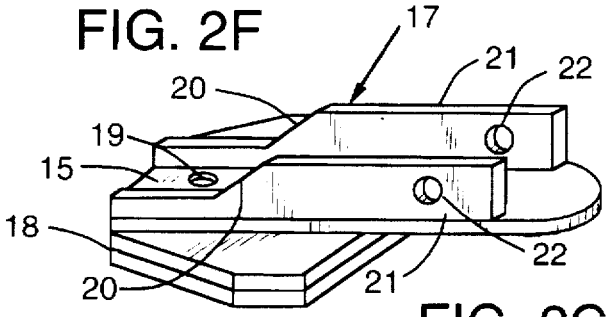
FIG. 2C is a perspective view of the swivel element.
Figure 2D:
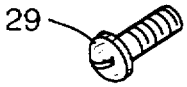
Figure 3:
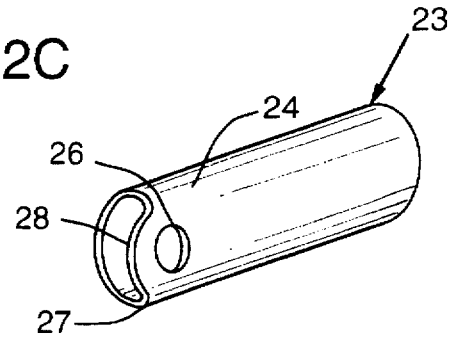
FIG. 3 is a perspetive view of one end of the pole which is flattened and cut back to receive a bolt attaching it to the ears of the swivel element.

A swivel element, denoted generally by the numeral 17, is shown in FIG. 2C and comprises a base plate 18 having a generally triangularly-shaped front end, having an aperture 19, and a generally rectangular back end. A reference mark 15 is provided at the triangularly-shaped front end of base plate 18 for alignment with reference line 9 on arm 6.. Base plate 18 bears a pair of upstanding, spaced apart ears 21 having apertures 22 therein. A hollow, telescopable pole, denoted generally by the numeral 23 (FIG. 3), with a number (e.g. three) of telescoping sections 64 and loosening and tightening rings 25 (FIG. 8), has a first flattened end 24 having a apertures 26 and cut back in a rounded end portion 27 to accommodate a filler or supporting material 28 to prevent collapse of the pole end when fastened to the swivel element 17 and tightened. Such attachment, forming a hinged joint, is made with threaded bolt 29 (FIG. 2D) passing through apertures 26 of the pole end 24, apertures 22 of the ears of the swivel element 17, through washer 31 (FIG. 2B) and into tightening knob 32 (FIG. 2A), so that pad 1 can hingedly turn about pole 24.

Figure 2G:
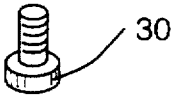

A swivel and sliding joint is formed by attaching swivel element 17 to arm 7 of base 4, by means of threaded bolt 30 (FIG. 2G) passing through aperture 19 in swivel element 17, slot 8 in arm 7 of base 4, through washer 33 (FIG. 2F) and into tightening knob 34 (FIG. 2E), whereby swivel element 17 is slidable in slot 8 and can swivel therein with respect to the pad 1. Bevelled front edges 20 of ears 21 are designed to fit in the space formed by the bevelled surface 3 of body 2 without contact therebetween on actuation of the swivel and sliding joint between arm 7 and the swivel element 17.

As shown in FIG. 1, the body 2 may be provided with a plurality of holes 35 for nailing the pad to a ridge board as one means of detachably securing the pad to the ridge board.

As shown in FIG. 4, a base angle is denoted generally by the numeral 36, and comprises a pair of, e.g. metal, angle elements fastened together, by means of fastener plates 37 and rivets or screws 38, and including a first, shorter arm 39 and a second, longer arm 41. The angle elements may be spaced apart to provide a slot 42 extending the length of the second arm 41. A slide clamp, denoted generally by the numeral 43 (FIG. 5) comprises an elongated body 44 having, at one end, a flattened portion 46 with an aperture 47 and, at the other end an upstanding leg 48 bearing a clamping foot 49 forming, with leg 48, a generally T-shaped member wherein the tips of the "T" extend beyond the sides of the second arm 41. Slide clamp 43 is mounted in the slot 42 of the second arm 41 of the base angle 36 by means of a slide element 51 (FIG. 6B) in the form of a rectangular plate having an aperture 50 and so dimensioned as to be receivable and slidable within the angle elements of arm 41, slide element 51 being secured to a threaded bolt 52 (FIG. 6A) which extends through aperture 50 in the slide element 51, through aperture 47 in flattened portion 46 of the slide clamp 43, through a washer 53 (FIG. 6C) and into a tightening knob 54 (FIG. 6D).

As further shown in FIG. 4, the second arm 41 of the base angle 36 is provided with a pair of spaced-apart ears 56 having apertures 57. Base angle 36 is hingedly connected to a second, flattened end 58 of pole 23 (FIG. 7A), having apertures 59 and containing a suitable supporting material 61, by means of a threaded bolt 62 (FIG. 7B) passing through apertures 59 in pole end 58, through apertures 57 in ears 56 of base angle 36, and into a tightening knob 63 (FIG. 7C).

Figure 8:
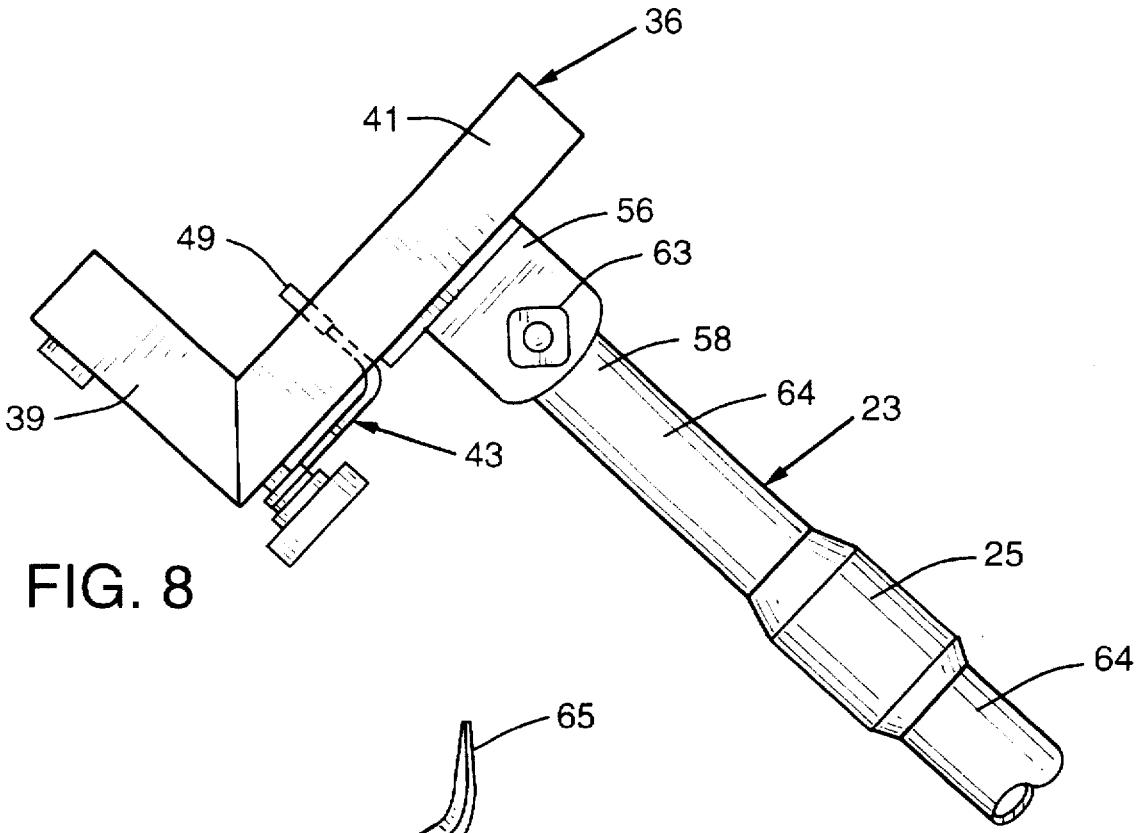
FIG. 8 is a side view of the end of the pole to which is attached the base angle.

FIG. 8 shows the base angle, with its component parts, assembled with the end 58 of pole 23, with tightening ring 25 and a pair of telescoping units 64 of standard construction and operation, the details of which are not shown.

Figure 9:
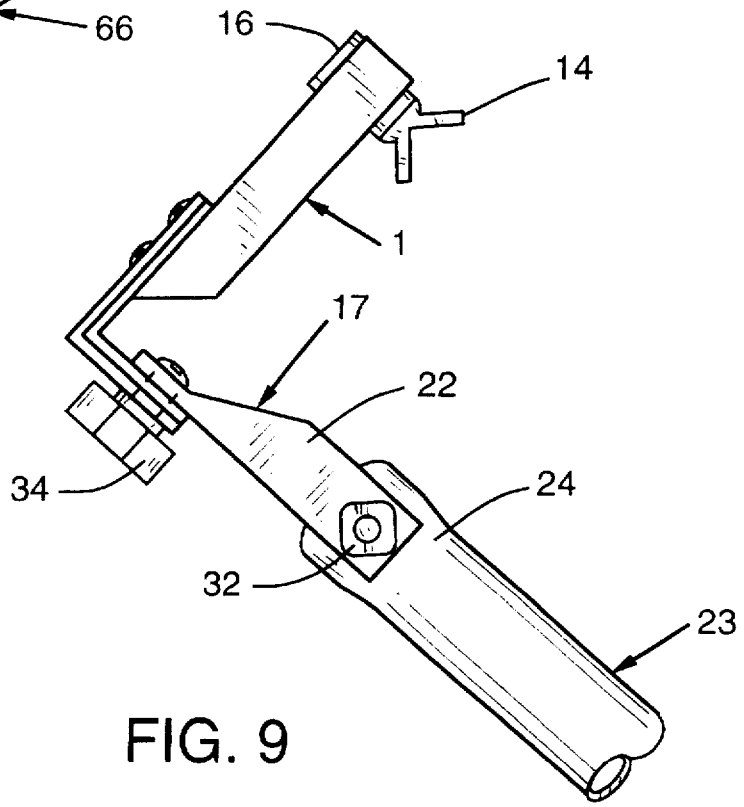
FIG. 9 is a side view of the end of the pole to which is attached the pad.

FIG. 9 shows the pad 1 and its component parts assembled with the end 24 of pole 23.

Figure 10:
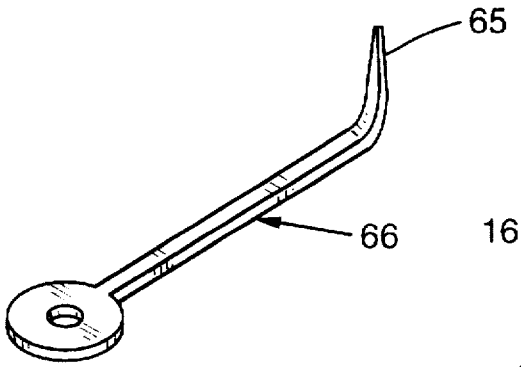
FIG. 10 is a perspective view of an alternate form of the slide clamp.
Figure 13:
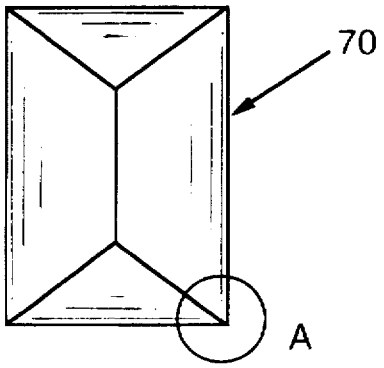
FIG. 13 is a top plan view of a hipped-roofed building for which a modified slide clamp is used.
Figure 14:
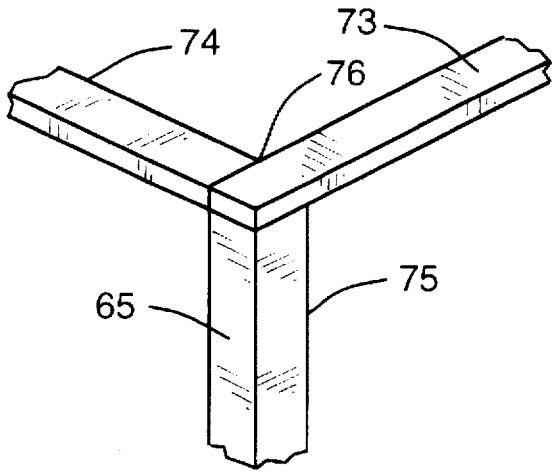
FIG. 14 is a perspective view of a wall corner with which the modified slide clam is used.
Figure 16:
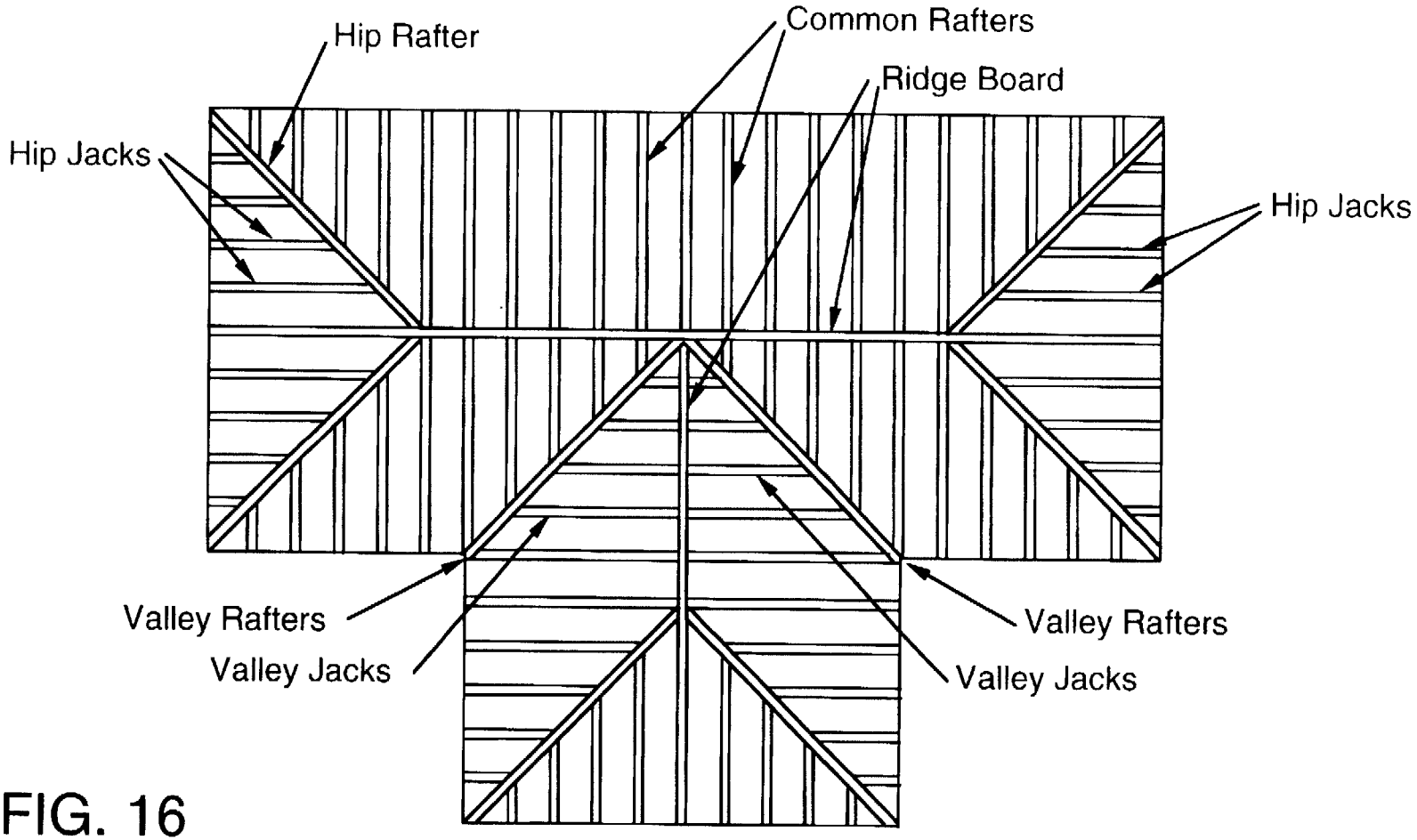
FIG. 16 is a top plan view of an intersecting hipped roof.

FIG. 10 shows an alternative form of slide clamp 66, particularly adapted, with a pointed dependent leg 65, for use in measuring angles and distances of corner rafters (hip rafters and valley rafters) for a hipped roof (see FIGS. 13, 14 and 16).

Figure 11:
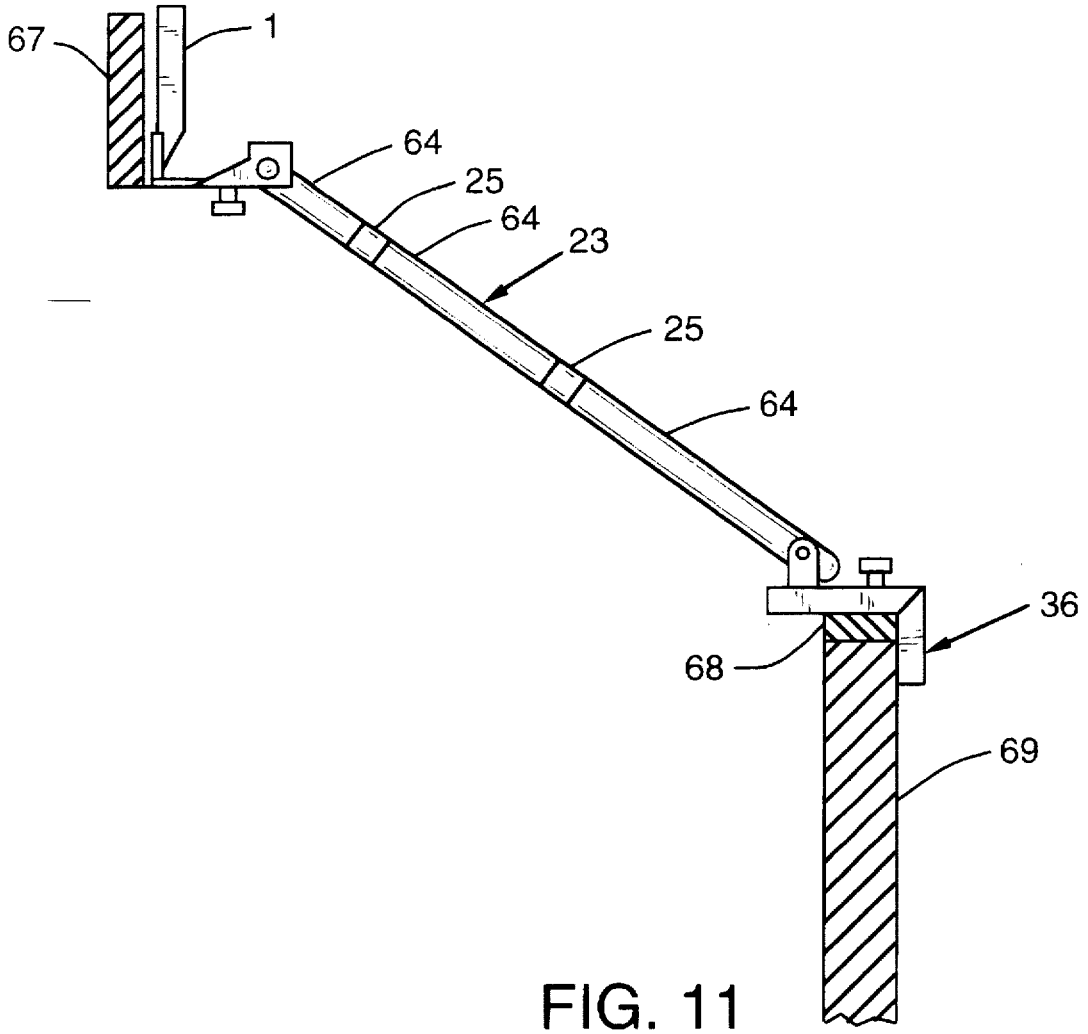
FIG. 11 is a side elevational view of the device of the invention in place between a ridge board and a wall plate.

In FIG. 11 there is depicted the device of the invention in use, extending from a ridge board 67, against which the pad 1 is positioned, to a wall plate 68, against which the base angle 36 is positioned, overlying wall studs 69.

Figure 12:
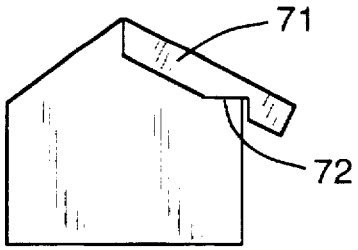
FIG. 12 is a sketch of a building showing, in exaggerated size a rafter with a birdsmounth cut.

The sketch of FIG. 12 shows, in exaggerated size, a gabled roof with rafter 71 into which a birdsmouth 72 is cut to fit the contour of the wall plate.

The sketch of FIG. 13 shows a hipped roof 70 with which the alternative slide clamp 66 is used, as at area A, which is shown in detail in FIG. 14 as comprising corner wall studs 65 and 75 with overlying corner wall plates 73 and 74, coming together to form inside corner 76. The device also is useful in determining the length and top end cut compound angle of hip rafters and valley rafters as well as hip jacks and valley jacks which adjoin, respectively, hip rafters and valley rafters, as shown in FIG. 16.

Figure 15:
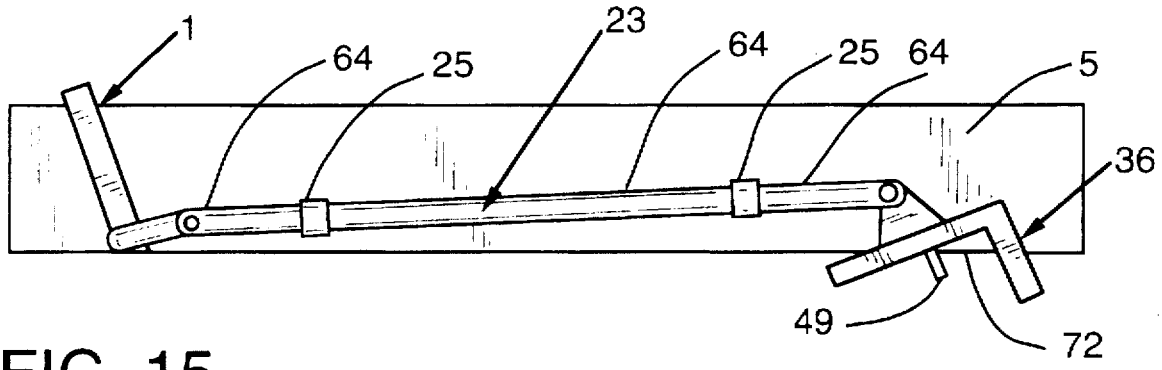
FIG. 15 is a top plan view of the device of the invention positioned on a rafter to be cut.

In operation, for a non-compound angle cut, i.e. for rafters used in the construction of gabled roofs, the device of the invention is used as a template. Knob 63 is loosened so that the base angle 36 may be positioned on the wall plate 68 and knob 63 then is tightened; rings 25 of pole 23 are loosened; knobs 32 and 34 are loosened and the pad 1 is placed against the ridge board 67 and knobs 32 and 34 are tightened along with rings 25. The device then is removed and, as shown in FIG. 15, it is placed over a rafter 5 to be cut. The tip of the "T" 49 of the slide clamp is positioned against the side of the rafter, the top end of the rafter then is marked against the pad 1 for cutting, and the birdsmouth 72 is marked for cutting against the base angle 36. The rafter then is cut.

For a compound angle cut, as in a hipped roof construction, where the ridge board, or a hip rafter, hip jack, valley rafter or valley jack, is not at a right angle to the length of the pole 23 positioned thereagainst, the device of the invention is positioned by using the rings 25 and the telescoping sections 64 of pole 23 to extend pole 23. Knob 63 of the base angle 36 and knobs 32 and 34 of the swivel element 17 are loosened, the base angle 36 is placed on the wall plate 68 (or, in the case of a valley jack, on the ridge board), and pad 1 is positioned by clamping or by nailing the pad, through holes 35, to the ridge board (or, in the case of a hip jack or valley jack, to the hip rafter or valley rafter) at reference line 10, by hingedly moving the pad 1 with respect to pole 23 and by swivelling the swivel element 17 with respect to arm 7 of the base 4 and attached body 2. The reference line 15 on base plate 18 is aligned with reference line 9 on arm 6 of base 4 and the pad 1 is positioned against the ridge board (or, for a hip jack or valley jack, to the hip rafter or valley rafter) to determine a compound angle between the pad and the ridge board (or the hip rafter or valley rafter), and the pad is held in such position by tightening knobs 32 and 34. The slide clamp 43 is held in place by tightening knobs 54 and 63 and the rings 25 of the telescoping units 64 on pole 23. By moving slide plate 16 in the U-shaped slot 11, the slide plate may be extended beyond the sides of pad 1 and, positioned adjacent reference line 10 on pad 1, effectively serves as an extension of the pad thereby facilitating marking of the rafter for the compound angle cut of the top end of the rafter. The device then is removed, positioned on the rafter to be cut, and the top of the rafter is marked against the slide plate 16 for angle of cut and, for length is marked against a 90° angle element (not shown), e.g. in the form of a rectangular block or channel with accurate 90° edges, which is held against the side of the pad 1, coinciding with reference line 10 and the top edge of the pad and with the slide clamp 43 resting against the bottom edge of the rafter. The lower end of the rafter is marked against the base angle for the birdsmouth cut. Thereafter the rafter is cut by using a bevel to set the saw angle.

For purposes hereof, when the term ridge board is used, it is deemed also to include, in the case of hip jacks and valley jacks as used in hipped roof construction (as shown in FIG. 16), a hip rafter or valley rafter to which the pad is juxtaposed for determining the compound angle between the corresponding rafter and jack. In such cases, the ridge board takes the place of the wall plate in operation of the inventive device.

Figure 17:
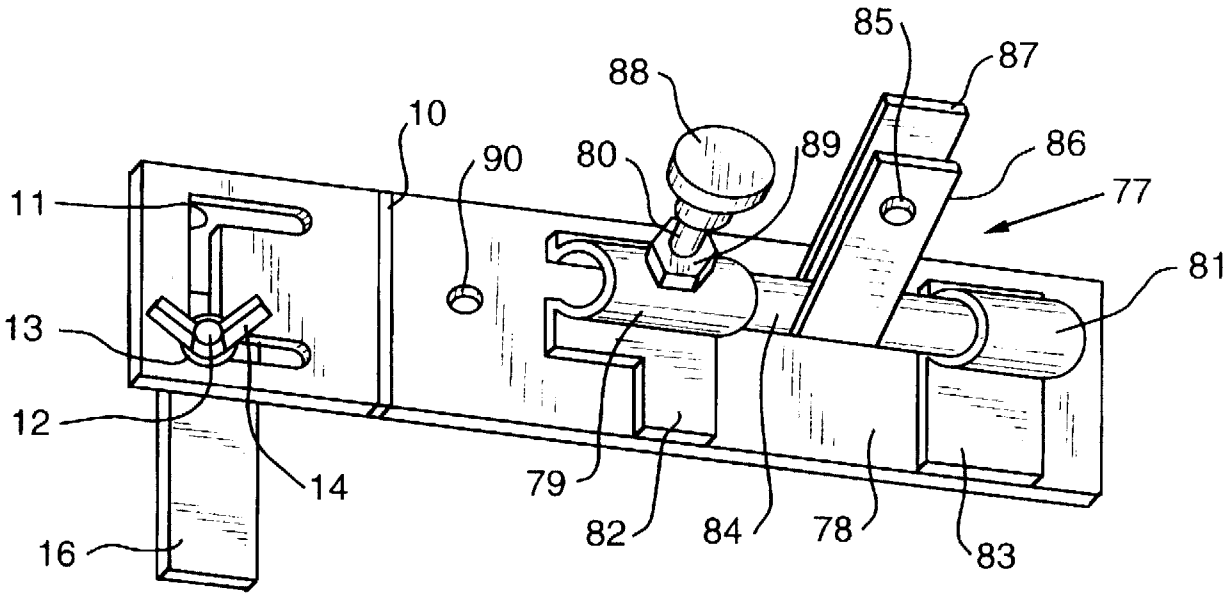
FIG. 17 is a perspective view of an alternative pad.

An alternative pad, denoted generally by the numeral 77, as shown in FIG. 17, comprises an elongated body element such as a flat, e.g. metal, plate 78 having at one end a U-shaped slot 11 as in the embodiment of FIG. 1 and within which the slide plate 16 is slidably movable and loosened or fixed by wing nut 14 disposed against washer 13 and connected to threaded bolt 12. Plate 78 bears a reference line 10, as in the case of the FIG. 1 embodiment of the pad and, like the pad of FIG. 1, has one or more apertures 90 for nailing the plate to the ridge board (or, for a hip jack or valley jack, to a hip rafter or valley rafter). Mounted on plate 78 is a pair of hollow housings 79 and 81 which are secured, e.g. as by welding, to plate 78 by means of tabs 82 and 83 respectively. A rod 84 is rotatably mounted in housings 79 and 81 and bears a pair of hinge plates 86 and 87 fixedly secured to the rod 84 and provided with a corresponding pair of apertures 85 for hingedly connecting the pad to the end of pole 23, e.g. by means of a threaded bolt and wing nut arrangement similar to shown in FIG. 1. Rod 84, in housings 79 and 81 (providing a swivel element), and with it the plate 78 and associated elements, is loosened for swivel-like rotary motion or secured in housings 79 and 81 by means of a threaded bolt 80 secured to tightening knob 88 and passing through a threaded nut 89 and bearing against rod 84. The alternative pad 77 thus is provided with hinge and swivel motions with respect to pole 23 as in the case of the embodiment of FIG. 1. To obtain a compound angle, it is sufficient to align the reference line 10 with the slide plate 16 and mark the top end of the rafter to be cut, as in the case of the FIG. 1 embodiment.

What is claimed is:

1. A rafter-like element measuring and positioning template device comprising:

a) a telescoping pole extendible between a first building construction element extending substantially horizontally of the building and a second construction element spaced from the first construction element and extending parallel or at an angle to the first construction element and to be connected thereto by rafter-like elements;

b) a pad comprising an elongated body swivably connected to one end of the pole and adapted to conform the pad position to a position of the second construction element;

c) a base angle comprising a pair of elongated arms at a right angle to one another, one of said arms having a slot extending substantially a length thereof and adapted to fit over the first construction element;

d) a slide clamp slidably mounted in the slot in the one arm of the base angle and adapted to be moved and held against one side of the first construction element, and e) means hingedly to attach the base angle to the other end of the pole, whereby, when the telescoping pole is extended with the pad in position against the second construction element and the slide clamp in position against the first construction element, the length of a rafter-like element to be placed between the first and second construction elements, the angle at which a second constuction element end of the rafter-like element is to be cut, and the position and dimensions of a birdsmouth cut to be made near a first construction element end of the rafter-like element, are accurately determined.

2. A device according to claim 1, wherein the pad comprises a flat plate body, a pair of spaced-apart hollow housings mounted on the body toward one end thereof, a rod rotatably mounted in the housings, a pair of apertured hinge plates secured to a portion of the rod between the housings and adapted to be hingedly connected through said apertures to the one end of the pole, whereby the pad is hingedly and swivably movable about the one end of the pole and adapted to be positioned against the second construction element for determining the length of the rafter-like element to be cut and the angle of cut of a second construction element end of the rafter-like element.

3. A device according to claim 2, wherein the plate has a U-shaped slot near the other end thereof, and a slide plate slidably movable in the slot, and means to loosen and tighten the slide plate in the U-shaped slot, whereby the slide plate can be extended beyond the sides of the pad and used to mark a compound angle of cut of an end of the rafter-like element adjacent the second construction element.

4. A device according to claim 1, wherein the slide clamp comprises an elongated body portion extending generally parallel to the slot in the one arm of the base angle and having an aperture in one end thereof for receiving a threaded bolt, a leg portion on the other end of the body portion extending vertically at a right angle to the body portion and forming a T-shaped element with a foot extending horizontally on either side of the leg portion at a right angle to the body portion and adapted to fit against the first construction element when the device is in position between the first construction element and the second construction element.

5. A device according to claim 1, wherein the slide clamp comprises an elongated body portion extending generally parallel to the slot in the one arm of the base angle and having an aperture in one end thereof for receiving a threaded bolt, a leg portion on the other end of the body portion extending vertically at a right angle to the body portion and terminating in a point and wherein said device is adapted to measure and position a corner rafter for a hipped roof.

6. A device according to one of claims 4 and 5, further comprising a slide element in the form of an apertured rectangular plate to which is attached the threaded bolt which extends through the aperture in said one end of the slide clamp and which also extends through the aperture in the slide element and which threaded bolt is secured to the slide element such that the slide clamp is slidingly movable with the slide element in a space defined by an opposed pair of walls of said one arm of the base angle and in the slot in said one arm of the base angle.

7. A rafter measuring and positioning template device comprising:

a) a telescoping pole;

b) a pad comprising an elongated body provided with a swivel element connected to one end of the pole enabling the pad to swivel about the one end of the pole and adapted to conform the pad position to a position of a ridge board when the pad is juxtaposed to the ridge board;

c) a base angle comprising a pair of arms at a right angle to one another, one of said arms having a slot extending substantially the length thereof, and adapted to fit over a wall plate;

d) a slide clamp slidably mounted in the slot in the one arm of the base angle and adapted to be moved and held against one side of the wall plate, and e) means hingedly to attach the base angle to the other end of the pole, whereby, when the telescoping pole is extended with the pad in position against the ridge board and the slide clamp in position against the wall plate, the length of a rafter to be placed between the ridge board and the wall plate, the angle at which a ridge board end of the rafter is to be cut, and the position and dimensions of a birdsmouth cut to be made near a wall plate end of the rafter, are accurately determined.

8. A device according to claim 7, wherein the pad body has a generally U-shaped slot formed therein near the other end thereof, and the pad further comprises a slide plate slidingly mounted in the U-shaped slot, and means to loosen and tighten the slide plate in the U-shaped slot, whereby the slide plate can be extended beyond the sides of the pad and used to mark a compound angle of cut of a second construction element end of the rafter.

9. A device according to claim 8, wherein the end of the body opposite the end having the U-shaped slot is bevelled, and the pad further comprises a base having a first arm secured to the body and extending beyond the bevelled end of the body and a second arm at a right angle to the first arm and having a slot for receiving a first threaded bolt for slidingly and rotatably attaching the swivel element to the body.

10. A device according to claim 9, wherein the swivel element comprises a base plate having a generally triangularly-shaped front portion having an aperture for reception of the first threaded bolt for attaching the swivel element to the body with the triangularly-shaped front portion positioned near and spaced from the bevelled end of the body.

11. A device according to claim 10, wherein the base plate of the swivel element comprises a generally rectangular rear portion having two upstanding and spaced-apart ears provided with aligned apertures for reception of a second threaded bolt for attaching the pad to the one end of the pole and forming a hinge joint between the one end of the pole and the swivel element, said ears having front portions thereof bevelled to fit under the bevelled surface of the block without contact therebetween.

12. A device for measuring the length of a rafter-like element to be disposed between a first construction building element extending substantially horizontally of the building and a second construction element spaced from the first construction element and extending parallel or at an angle thereto and for measuring the angle of the second construction element, comprising a telescoping pole, an elongated pad swivably connected at one end to one end of the pole and thereby conformable to the position of the second construction element, a base angle hingedly connected to the other end of the pole and comprising two right angle arms adapted to rest on the first construction element, a U-shaped slot in the pad near the other end thereof, a slide plate slidably and rotatable mounted in the slot, and means to loosen and tighten the slide plate in the U-shaped slot, whereby, on extention of the pole when the pad is positiioned against the second construction element, the angle between the second construction element and a corresponding end of the rafter-like elemenmt to be cut, the length of the rafter-like element, and the position and dimensions of a birdsmouth to be cut near the other end of the rafter-like element, are determined, and whereby the slide plate can be extended beyond the sides of the pad and used to mark a compound angle of cut of an end of the rafter-like element adjacent the second construction element.

13. A device according to claim 12, wherein one arm of the base angle has a generally U-shaped cross section and is provided with a slot extending substantially the length of the arm, and further comprising a slide clamp slidably mounted in said slot and having a body portion extending generally parallel to said slot, a leg portion extending vertically at substantially a right angle to the body portion, and a foot portion extending horizontally at substantially a right angle to the leg portion and adapted to be positioned against the first construction element.

14. A device according to claim 13, wherein the leg and foot portions of the slide clamp are in the form of a T adapted to be positioned against the first construction element and wherein ends of the T extend above and beyond the U-shaped sides of said one arm of the base angle and, when the device is placed on a rafter-like element to be cut, is engageable with a side of the rafter-like element, whereby the base angle can be used to mark the position and dimensions of a birdsmouth to be cut near an end of the rafter-like element adjacent the first construction element.

15. A device according to claim 13, wherein the leg portion of the slide clamp terminates in a point and adapted to be positioned against a corner of the first construction element when the device is used to determine the length of a corner rafter-like element of a hipped roof.

16. A method of measuring and positioning a rafter-like element between a first building construction element extending substantially horizontally with respect to the building and a second building construction element spaced from the first construction element and extending parallel or at an angle thereto, comprising:

a) swivably attaching, to one end of a telescoping pole, a pad comprising an elongated body;

b) hingedly attaching, to another end of the pole, a base angle comprising two arms at a right angle to each other;

c) forming a slot extending along a length of one of said arms;

d) mounting a footed slide clamp within the slot in said one arm of the base angle such that a foot of the slide clamp is positionable against the first construction element;

e) extending the telescoping pole so that the body of the pad rests against the second construction element and the foot of the slide clamp rests against the first construction element;

d) fixing the pad and the slide clamp in their respective such positions, and thereby determining the length of a rafter-like element to extend between the first and second construction elements and also determining an angle between the second construction element and the pad and corresponding to the angle at which an end of the rafter-like element adjacent the second construction element is to be cut.

17. A method according to claim 16, further comprising providing a slide plate slidably and rotationally movable within a generally U-shaped slot in one end of the body, positioning the slide plate within the U-shaped slot and adjacent a reference line on the pad indicating an end of the rafter-like element to be cut, extending the slide plate beyond the sides of the pad, and marking the rafter-like element against the slide plate with a compound angle between the pad and the second construction element.

18. A method according to claim 17, wherein, after the length and angle of the rafter-like element to be cut are determined, the device is placed on the rafter-like element to be cut, the foot of the slide clamp is juxtaposed to a side of the rafter-like element near a first construction element end thereof, and the position and dimensions of a birdsmouth cut to be made near the latter end of the rafter-like element are marked against the arms of the base plate.

19. A method according to claim 17, comprising holding a 90° angle element against a top side edge of the pad along a reference line on the pad, while the slide clamp is rested against the first construction element, and marking the rafter-like element against the the 90° angle, to determine an accurate length of the rafter-like element.

* * * * *